United States Patent [19]

Ōsawa et al.

[11] Patent Number: 4,532,904

[45] Date of Patent: Aug. 6, 1985

[54] AIR-FUEL RATIO CONTROL DEVICE FOR INTERNAL COMBUSTION ENGINES

[75] Inventors: Tadao Ōsawa, Katsuta; Toru Nakagawa, Mito; Masamitsu Okumura, Katsuta; Takashige Kohno; Tokihiko Sakuma, both of Hitachi, all of Japan

[73] Assignee: Hitachi, Ltd., Tokyo, Japan

[21] Appl. No.: 465,182

[22] Filed: Feb. 9, 1983

[30] Foreign Application Priority Data

Feb. 17, 1982 [JP] Japan ..... 57-22645

[51] Int. Cl.[3] ..... F02M 13/02

[52] U.S. Cl. ..... 123/439; 123/580

[58] Field of Search ..... 123/439, 438, 580, 59 PC, 123/579

[56] References Cited

U.S. PATENT DOCUMENTS

| | | | |
|---|---|---|---|
| 3,931,814 | 1/1976 | Rivere | 123/438 |
| 3,963,009 | 6/1976 | Mennesson | 123/440 |
| 4,091,781 | 5/1978 | Mituyasu et al. | 123/59 PC |
| 4,314,534 | 2/1982 | Nakajima et al. | 123/438 |
| 4,349,877 | 9/1982 | Oyama et al. | 123/439 |
| 4,366,793 | 1/1983 | Coles | 123/438 |
| 4,369,749 | 1/1983 | Sugi | 123/439 |

*Primary Examiner*—Andrew M. Dolinar

*Attorney, Agent, or Firm*—Antonelli, Terry & Wands

[57] ABSTRACT

An air-fuel ratio control device for an internal combustion engine equipped with a plurality of variable venturi type carburetors each having a slow system, in which the flow rate of air supplied to the slow systems of the carburetors is controlled depending on the engine operation parameters including, for example, the temperature of intake air, temperature of engine oil and atmospheric pressure to improve the rate of atomization of fuel, thereby improving the idling performance of the engine and therefore improving the fuel consumption of the engine.

2 Claims, 13 Drawing Figures

AIR-FUEL RATIO CONTROL DEVICE FOR INTERNAL COMBUSTION ENGINES

This invention relates to a fuel supply system in an internal combustion engine, and, more particularly, to an air-fuel ratio control device suitable for use with a multiple carburetor including a plurality of variable venturi type carburetors each of which is provided with a slow system.

In an internal combustion engine equipped with a prior art variable venturi type carburetor provided with a slow system, that is, an air valve type carburetor, the air-fuel ratio of the air-fuel mixture tends to become lean in the region in which the rotation speed of the engine is low and the load of the engine is heavy. This is because the operation of the slow system is influenced directly by the negative pressure or vacuum in the intake pipe. Since the leanness of the air-fuel ratio in the above region degrades the accelerability of the internal combustion engine, the fuel system is generally so designed that such a lean air-fuel ratio is corrected to achieve the proper ratio by increasing the flow rate of fuel supplied through the main system. However, with such a manner of correction, the air-fuel ratio of the air-fuel mixture supplied in the steady operation region of the engine, in which the flow rate of air is equal to that corresponding to the low-rotation heavy-load operation region of the engine, becomes necessarily rich, resulting in an undesirable degradation of the fuel consumption. In addition, the air-fuel ratio varies depending upon the environmental conditions including the ambient temperature and atmospheric pressure, and it is thus difficult to maintain the air-fuel ratio at the predetermined setting with high accuracy and reliability.

In an effort to solve such prior art problems, application of an electronic air-fuel ratio control device to the multiple carburetor has been proposed. However, because of the fact a main-system control solenoid valve and a slow-system control solenoid valve are required for each of the individual carburetors, the structure of the control circuit becomes inevitably complex due to the requirement for provision of such many solenoid valves. Therefore, the proposed air-fuel ratio control device is defective in that it is very expensive.

An air valve type carburetor is disclosed in U.S. Pat. No. 3,963,009 wherein air is used for controlling the flow rate of fuel supplied from the main nozzle. In other words, the flow rate of air flowing through the air bleed is controlled by a duty controlled valve.

It is a primary object of the present invention to provide an air-fuel ratio control device of simple construction and of low manufacturing cost which can improve the rate of atomization of fuel in an internal combustion engine equipped with a plurality of variable venturi type carburetors each having a slow system, thereby improving the idling performance and fuel consumption of the engine.

The present invention attains the above object by the provision of an air-fuel ratio control device for an internal combustion engine equipped with a multiple carburetor including a plurality of variable venturi type carburetors each having a slow system, which control device comprises a plurality of sensors sensing various parameters relating to engine operating characteristics, a control circuit receiving the output signals from the plurality of sensors as its inputs to make necessary arithmetic and logic processing of the inputs, and a solenoid valve controlling the flow rate of air flowing through the slow systems, with the solenoid valve being intermittently opened and closed under command of the control circuit thereby correcting the flow rate of fuel supplied to the carburetors.

The present invention will be apparent from the following detailed description taken in conjunction with the accompanying drawings, in which.

Preferred embodiments of the present invention will now be described in detail with reference to the accompanying drawings.

Figure 1:
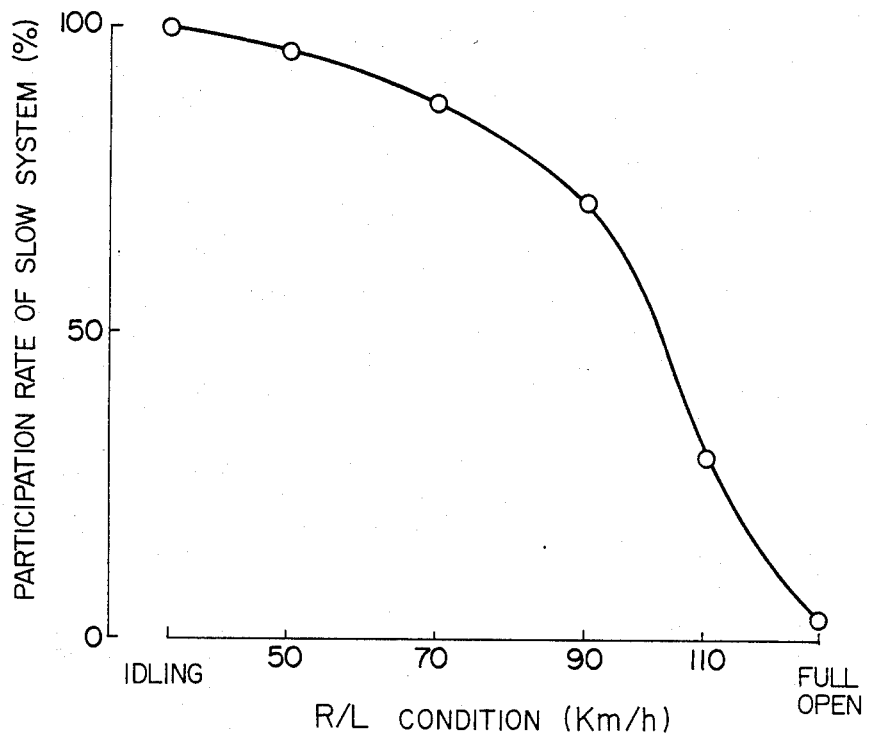
FIG. 1 is a graph showing the relationship between the R/L condition and the fuel-supply participation rates of a slow system and a main system of a variable venturi type carburetor having such a slow system.

Referring now to the drawings wherein like reference numerals are used throughout the various views to designate like parts and, more particularly, to FIG. 1, according to this figure, the proportion of fuel supplied through the slow system is about 70% at a point corresponding to the R/L condition of 90 km/h and about 30% at a point corresponding to the R/L condition of 110 km/h. Therefore, for the purpose of optimized control of the air-fuel ratio in the economical fuel consumption region of vehicles, the desired improvement in, for example, the fuel consumption can be sufficiently achieved by merely controlling the operation of the slow system alone. Based on the finding above described, the present invention realizes an electronically-controlled inexpensive air-fuel ratio control device in which the slow system alone is electronically controlled by a simple control circuit so as to minimize the number of required solenoid valves.

Figure 2:
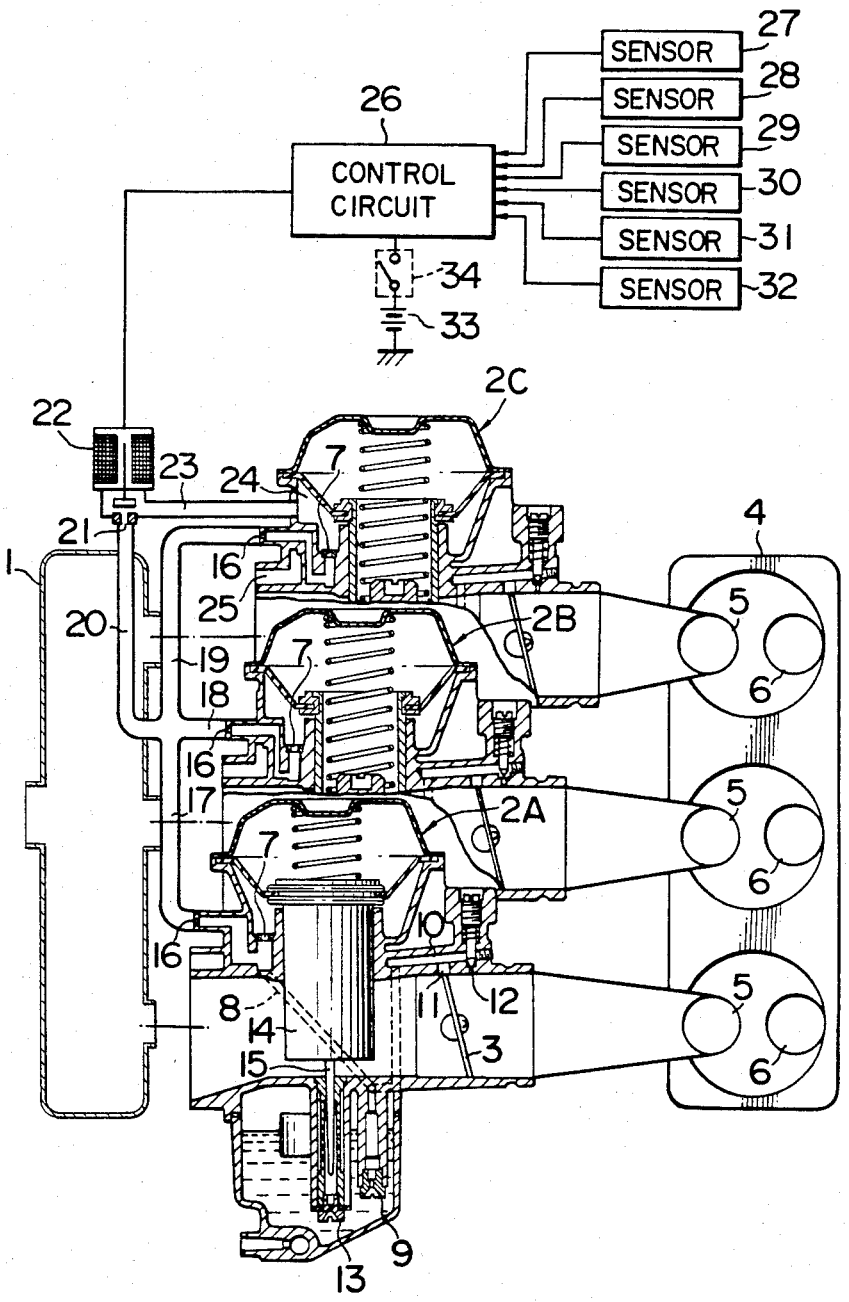
FIG. 2 is a partly sectional and partly diagrammatic, elevation view showing an embodiment of the air-fuel ratio control device according to the present invention.
Figure 3:
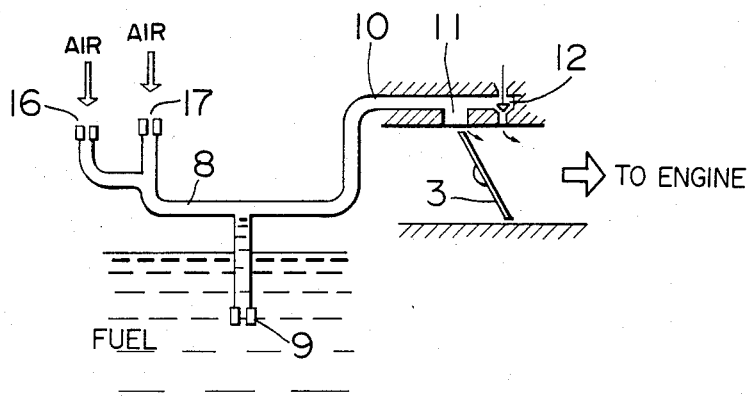
FIG. 3 is a schematic sectional view showing how air and fuel are mixed together in the slow system in the embodiment of the present invention shown in FIG. 2.

As shown in FIG. 2, an air cleaner 1 communicates with a plurality of, for example, three carburetors 2A, 2B and 2C, and the air-fuel mixture path on the downstream side of a throttle valve 3 disposed in each of these three carburetors 2A, 2B and 2C communicates with an inlet valve 5 provided on an associated cylinder of an engine 4 of, for example, a motorcycle. An exhaust valve 6 is also provided on each of the cylinders of the engine 4. Each of the carburetors 2A, 2B and 2C is provided with a slow system and a main system as its fuel system. The slow system includes a slow air bleed 7, an air bleed passage 8, a pilot jet 9, an air-fuel mixture passage 10 for the air-fuel mixture passing through the slow system, a bypass port 11 and an idle hole 12. In the slow system, fuel is metered by the pilot jet 9 and flows through the bypass port 11 to be supplied through the idle hole 12 to a position on the downstream side of the throttle valve 3. On the other hand, the main system includes a main jet 13, a suction piston 14 and a jet needle 15 fixedly connected to the suction piston 14. In the main system, fuel flowing through the main jet 13 is metered by the jet needle 15 to be supplied to the venturi.

Auxiliary air bleeds 16, arranged in parallel with the slow air bleeds 7 of the individual carburetors 2A, 2B and 2C, are connected at their upstream ends with passages 17, 18 and 19, respectively, and these passages 17, 18 and 19 join together at their upstream ends to communicate with a single passage 20. An orifice 21 is provided at the upstream end of this passage 20. This orifice 21 is opened and closed by an associated solenoid valve 22 whose on-off duty is controlled by a signal described later. The upstream side of the orifice 21 communicates through a passage 23 with a lower one 24 of two chambers defined in the carburetor 2C by a diaphragm. This lower chamber 24 communicates with an air horn passage 25. However, the passage 23 may be connected directly to the air cleaner 1 without adversely affecting the desired control.

The solenoid valve 22 is electrically connected to a control circuit 26 to be actuated under command of the control circuit 26. An intake vacuum sensor 27, an intake air temperature sensor 28, an engine oil temperature sensor 29, an atmospheric pressure sensor 30 and an idling switch 31 disposed at suitable positions of the engine 4 apply their output signals to the control circuit 26, and an ignition signal 32 is also applied to the control circuit 26. This ignition signal 32 means the output signal from a sensor sensing the angular position of rotation of the engine crankshaft. A battery 33 supplies power to the control circuit 26 through a key switch 34.

The slow system in each of the carburetors 2A, 2B and 2C is so designed that air-passing area of the slow air bleed 7 is set so as to provide a richest air-fuel ratio of combustible limit when the orifice 21 is fully closed by the solenoid valve 22, and the auxiliary air bleed 16 is set to provide a leanest air-fuel ratio of combustible limit when the orifice 21 is full opened by the solenoid valve 22. Under the conditions in which the slow air bleed 7 and the auxiliary air bleed 16 in each of the slow systems are set as described above, the control circuit 26 receives the output signals from the intake vacuum sensor 27, intake air temperature sensor 28, engine oil temperature sensor 29, atmospheric pressure sensor 30 and idling switch 31 together with the ignition signal 32 and arithmetically and logically processes the input signals according to a stored program. Then, the control circuit 26 applies its output pulse signal for actuating the solenoid valve 22, and the solenoid valve 22 acts to suitably open and close the orifice 21, so that the air-fuel ratio of the air-fuel mixture supplied through the slow system can always be controlled to be optimum. The slow system and the main system composing the fuel system are independent of each other. In the idling region, fuel is supplied through the slow system only, while, when the R/L condition exceeds about 40 km/h, fuel is also supplied through the main system. Since the slow system is independent of the main system, the proportion of fuel supplied through the slow system is still large or about 70% at the R/L condition of about 90 km/h, as described already. Thus, the control of the air-fuel ratio of the air-fuel mixture supplied through the slow system by the solenoid valve 21 which is on-off controlled by the pulse signal applied from the control circuit 26 is enough to correct the air-fuel ratio in the economical fuel consumption region.

It will be seen from the above description of the embodiment of the present invention that the control circuit 26 processes input signals indicative of various operating parameters of the engine 4 according to a stored program and generates a pulse signal actuating the solenoid valve 22 which opens and closes the orifice 21 as commanded. Therefore, the air-fuel ratio can be maintained to be optimum thereby improving the fuel consumption. Further, because of the fact that the electronic control of the air-fuel ratio by the combination of the control circuit 26 and the solenoid valve 22 is applied only to the slow system. Only one solenoid valve 22 and the control circuit 26 of relatively simple structure are required for the electronic control of the air-fuel ratio so that such control can be achieved at a low cost.

Figure 4:
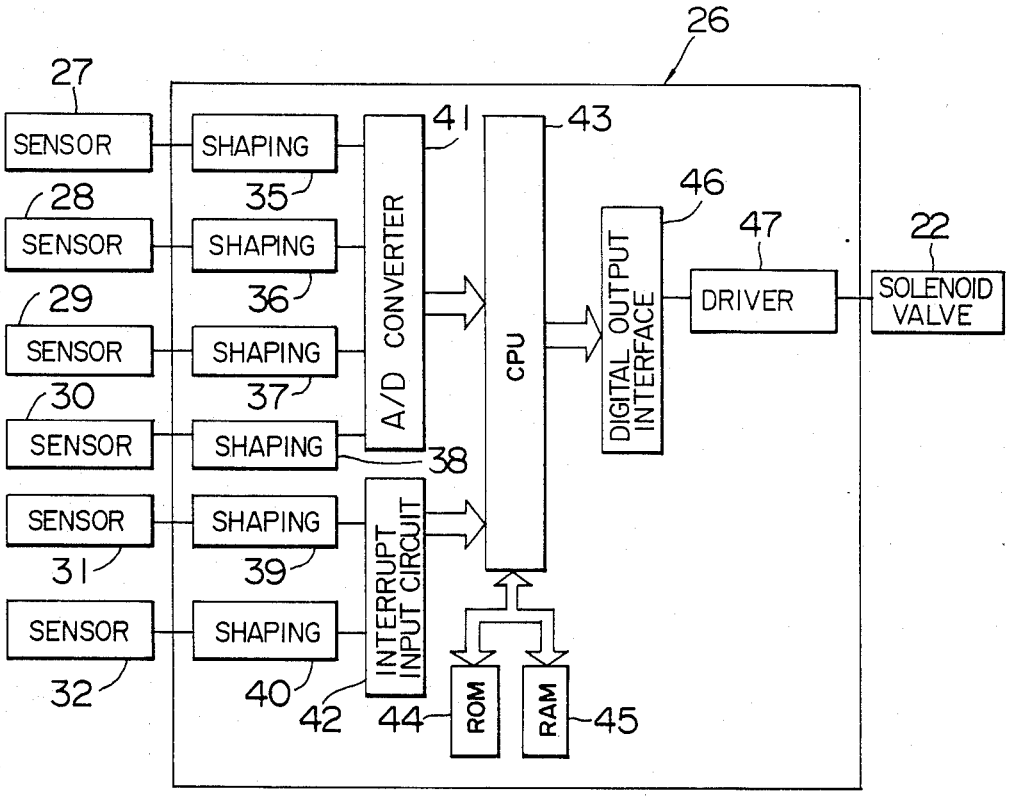
FIG. 4 is a block circuit diagrams showing schematically the structure of the control circuit in the embodiment shown in FIG. 2.

Referring to FIG. 4, the control circuit 26 includes waveform shaping circuits 35, 36, 37, 38, 39, 40, an A/D converter 41, an interrupt input interface 42, a central processing unit (abbreviated hereinafter as a CPU) 43, a read-only memory (abbreviated hereinafter as an ROM) 44, a random access memory (abbreviated hereinafter as an RAM) 45, a digital output interface 46 and a driver circuit 47.

Referring to FIG. 4, two kinds of interrupt signals IRQ are applied to the interrupt input interface 42. One of these signals IRQ is a fixed-time interrupt signal applied at predetermined time intervals, and the other is a fixed-position interrupt signal applied each time the crankshaft of the engine 4 rotates to a predetermined angular position of rotation. The latter interrupt signal is derived from the ignition signal 32 applied through the shaping circuit 40. In response to the application of one of such interrupt signals IRQ, the CPU 43 executes predetermined arithmetic and logic processing on the basis of fixed data stored in the ROM 44 in accordance with a predetermined program stored in the ROM 44.

Figure 5:
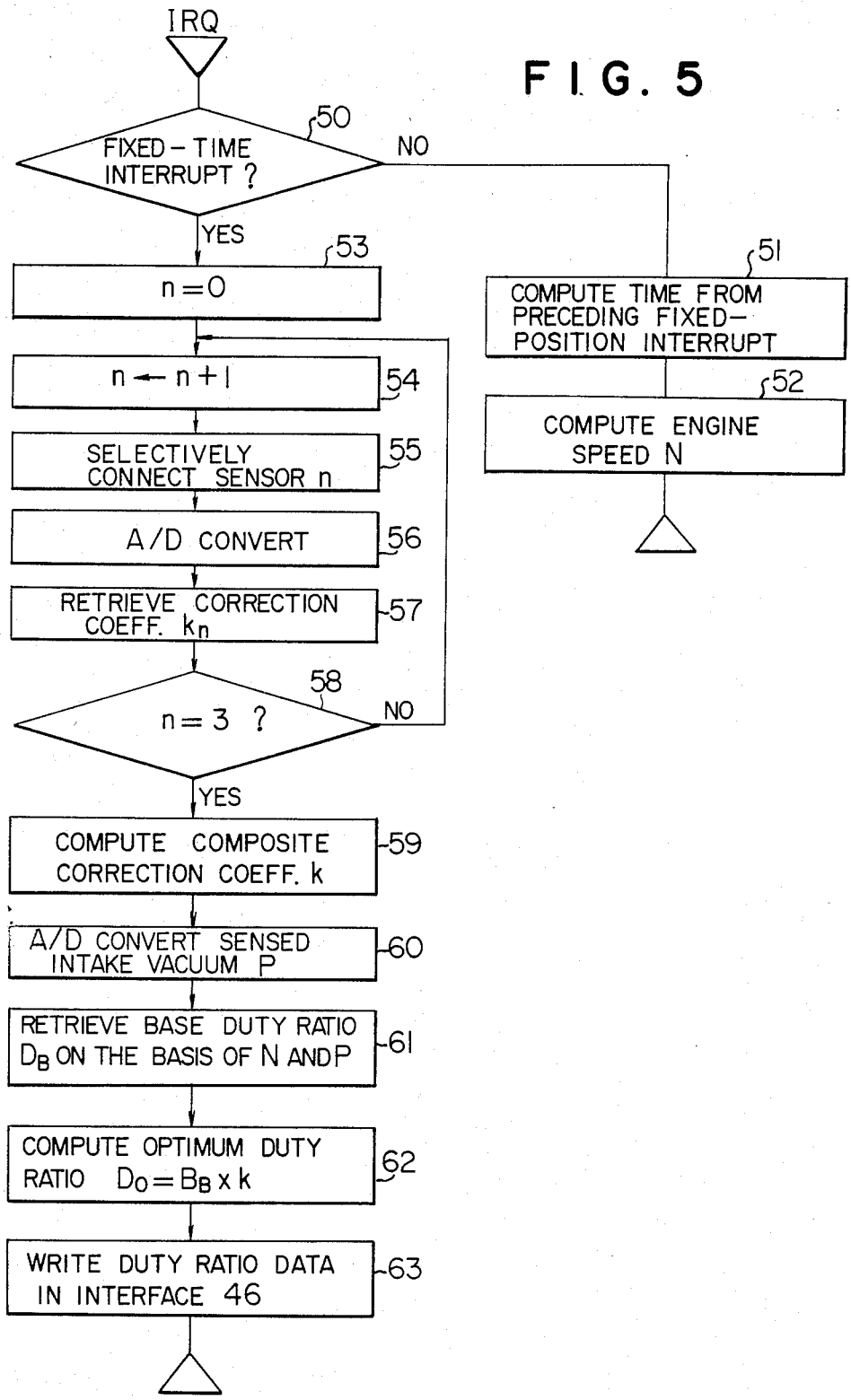
FIG. 5 is a flow chart illustrating the operation of the control circuit shown in FIG. 4.

As shown in FIG. 5, in response to the application of the interrupt signal IRQ to the control circuit 26, whether this interrupt signal IRQ is the fixed-time interrupt signal or the fixed-position interrupt signal is discriminated in step 50. When the result of discrimination in step 50 proves that the fixed-position interrupt signal is the interrupt input IRQ, the length of time elapsed from the time of application of the preceding fixed-position interrupt signal to the time of application of the present fixed-position interrupt signal is computed in step 51, and, on the basis of the computed value of the length of time, the rotational speed (rpm) N of the engine 4 is computed in step 52.

Figure 8:
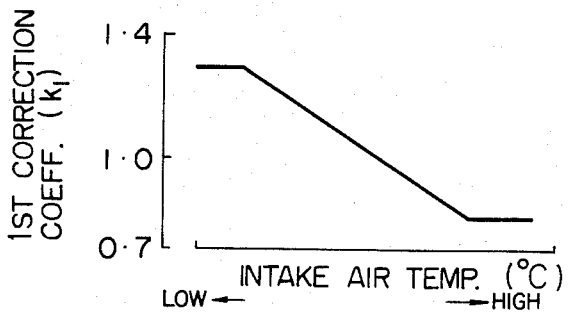
FIGS. 8, 9 and 10 are graphs showing a first, a second and third correction coefficient used for correcting the air-fuel ratio depending on the temperature of intake air, temperature of engine oil and atmospheric pressure respectively.
Figure 9:
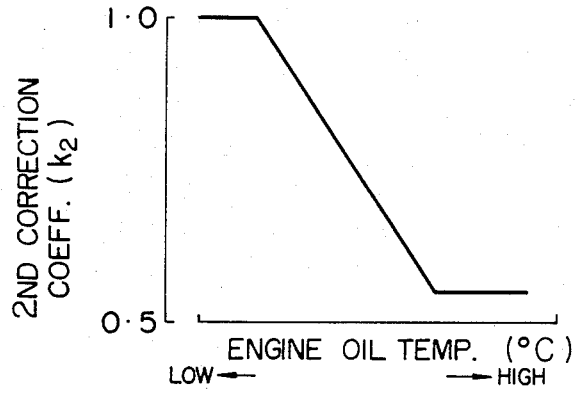
Figure 10:
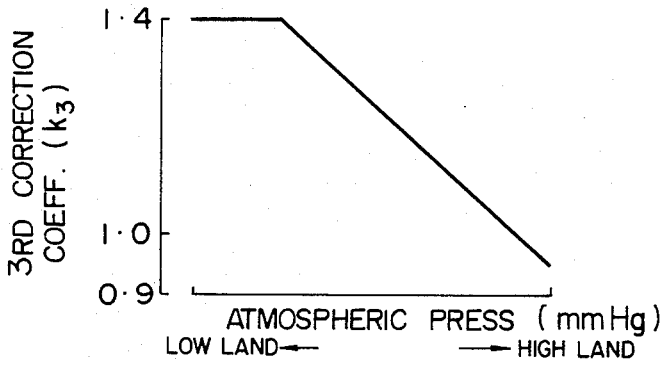

On the other hand, when the result of discrimination in step 50 proves that the fixed-time interrupt signal is the interrupt input IRQ, the step 50 is followed by steps 53 to 57 in which n correction coefficients $k_n$ are retrieved. Herein, $n=3$, and there are three correction coefficients which include a first correction coefficient $k_1$ used for correcting the temperature of intake air sensed by the intake air temperature sensor 28, a second correction coefficient $k_2$ used for correcting the temperature of engine oil sensed by the engine oil temperature sensor 29, and a third correction coefficient $k_3$ used for correcting the atmospheric pressure sensed by the atmospheric pressure sensor 30. These correction coefficients $k_1$, $k_2$ and $k_3$ are shown in FIGS. 8, 9 and 10, respectively.

In step 53, n is initialized to be n=0. In step 54, n is set at n=n+1. In step 55, the intake air temperature sensor 28 corresponding to the first correction coefficient $k_1$ is selectively connected to the control circuit 26, and, in step 56, the output signal from this sensor 28 is converted by the A/D converter 41 into the corresponding digital value after level conversion by the associated shaping circuit 36. On the basis of this digital value, the correction coefficient $k_1$ shown in FIG. 8 is retrieved. In this manner, the output signals from the intake air temperature sensor 28, engine oil temperature sensor 29 and atmospheric pressure sensor 30 sensing the operating parameters of the engine 4 are level-converted by the respective shaping circuits 36, 37 and 38 and are then sequentially converted into the corresponding digital values respectively by the A/D converter 41. Then, the correction coefficients $k_1$, $k_2$ and $k_3$ shown in FIGS. 8, 9 and 10, respectively, are retrieved on the basis of these digital values. In step 58, judgment is made as to whether or not all of the three correction coefficients $k_1$, $k_2$ and $k_3$ have been retrieved.

Figure 7:
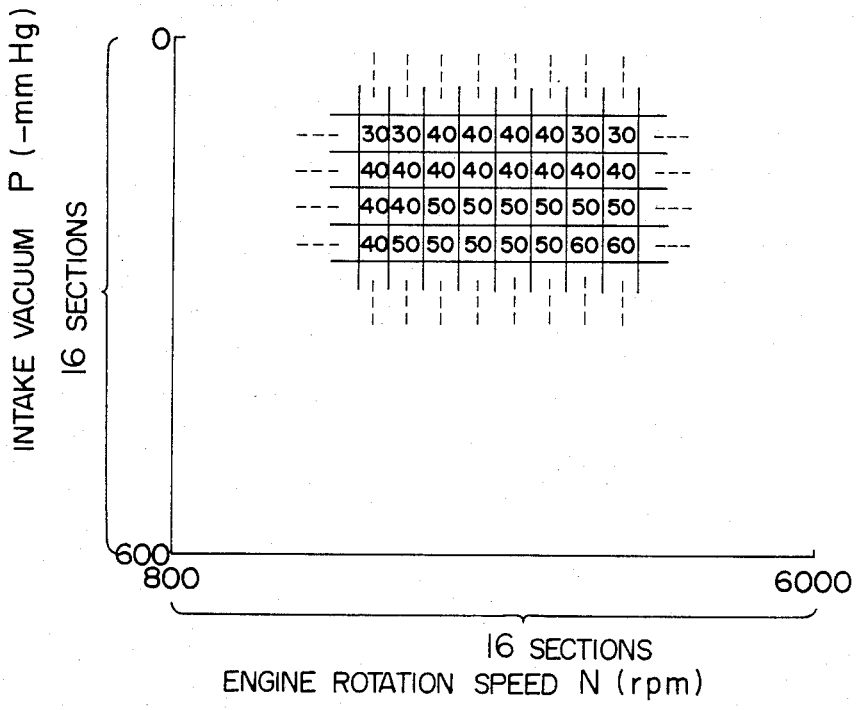
FIG. 7 is a graph showing the relationship between the rotation speed of the engine and the negative pressure or vacuum in the intake pipe.

When the result of judgment in step 58 is "yes", the composite correction coefficient k ($k=k_1+k_2+k_3$) is computed in step 59. Then, in step 60, the output signal from the intake vacuum sensor 27 sensing the vacuum in the intake pipe of the engine 4 is converted by the A/D converter 41 into the corresponding digital value after level conversion by the associated shaping circuit 35. On the basis of the data P indicative of the sensed intake vacuum and the engine rotation speed (rpm) N computed in the step 52, the corresponding data indicative of the duty ratio of current to be supplied for actuating the solenoid valve 22, as shown in FIG. 7, is retrieved in step 61. In FIG. 7, the region of the engine rotation speed N ranging from 800 rpm to 6,000 rpm is equally divided into 16 sections, and the intake vacuum P ranging from 0 mmHg to −600 mmHg is similarly equally divided into 16 sections. Thus, the relationship between the engine rotation speed N and the intake vacuum P is divided into 256 blocks, and the duty ratios of, for example, 30%, 40%, 50%, . . . are allotted to the individual blocks, such data being stored in the ROM 44. Therefore, when the engine rotation speed N and intake vacuum P are determined, the corresponding preferable base duty ratio $D_B$ is retrieved in step 61 from the data map shown in FIG. 7.

In step 62, this base duty ratio $D_B$ is multiplied by the composite correction coefficient k computed already in step 59 to provide the optimum duty ratio $D_o=D_B\times k$. Then, in step 63, this data $D_o$ is written in the digital output interface 46 to be used to produce a duty current waveform of constant period in the driver circuit 47 which actuates the solenoid valve 22.

As described above, the solenoid valve 22 is actuated by the current of constant period. By changing the duty ratio of the actuating current, the flow rate of air flowing through the orifice 21 is changed correspondingly, with the result that the flow rate of air flowing through the auxiliary air bleeds 16 is changed correspondingly.

Figure 6:
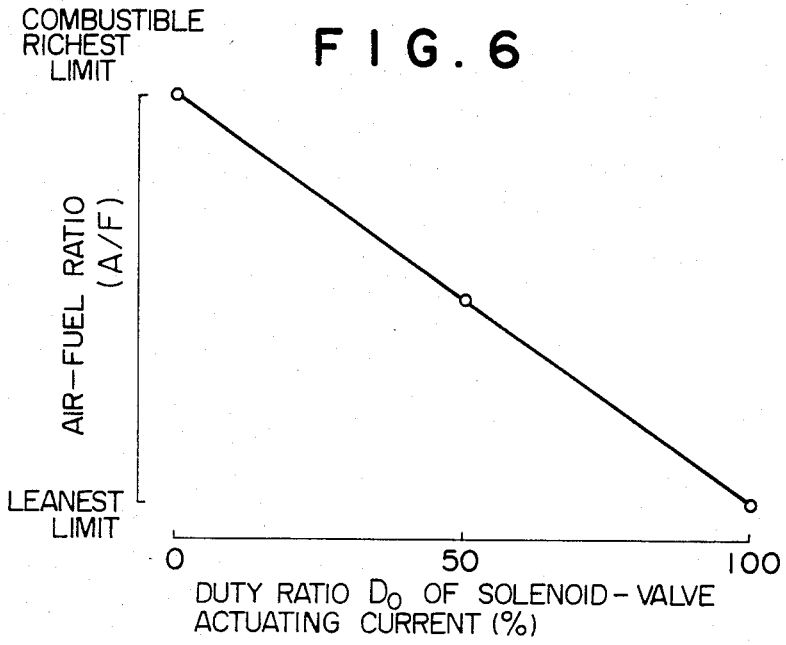
FIG. 6 is a graph showing the relationship between the duty ratio of the solenoid-valve actuating signal and the air-fuel ratio.

As shown in FIG. 6, the air-fuel ratio A/F is linearly controlled by controlling the duty ratio $D_o$ of the current actuating the solenoid valve 22 in accordance with the present invention. Preferably, the duty ratio $D_o$ is controlled between 20 Hz and 40 Hz.

In the embodiment of the present invention described with reference to FIG. 2, the flow rate of air supplied through the slow system is controlled for controlling the air-fuel ratio. However, in lieu of the air flow rate control, the flow rate of fuel supplied through the slow system may be controlled to achieve the effect similar to that exhibited by the aforementioned embodiment.

Figure 11:
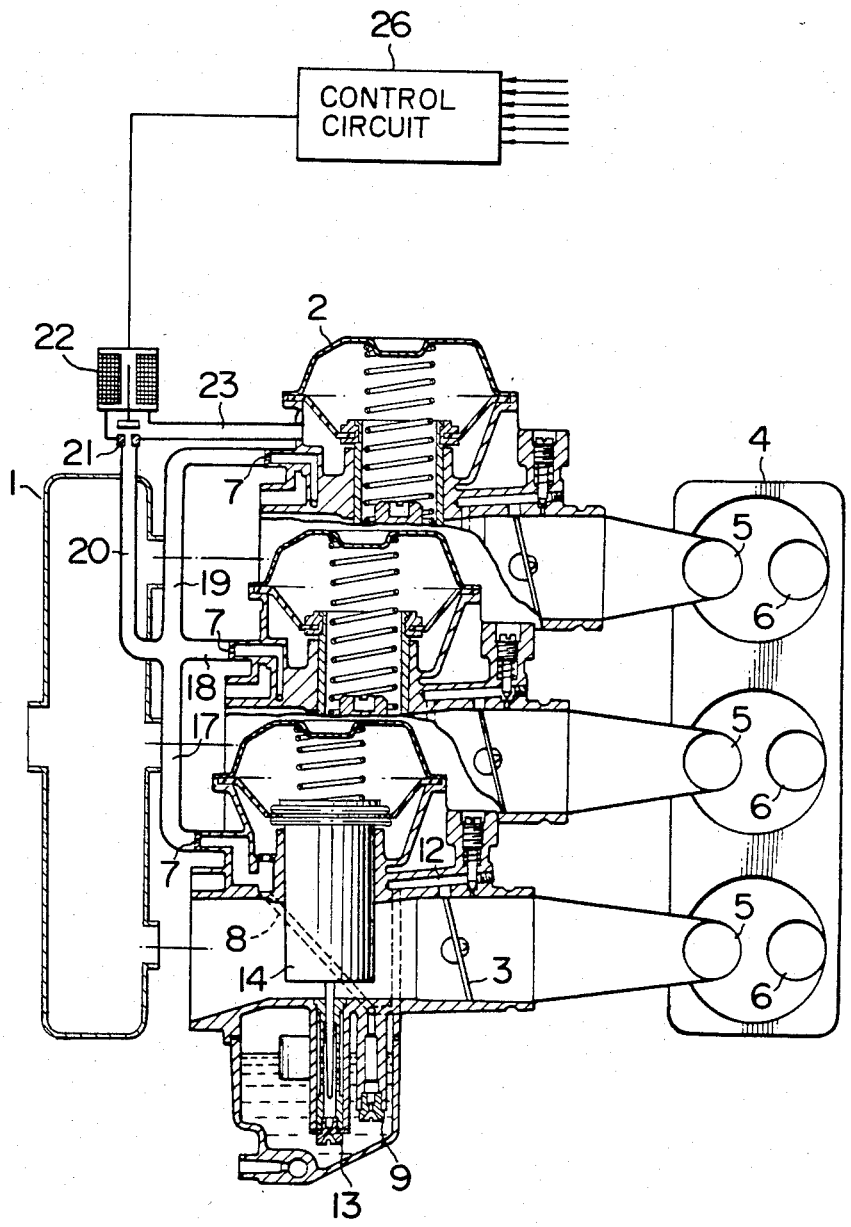
FIGS. 11, 12 and 13 are views similar to FIG. 2 but respectively showing other embodiments of the present invention.

The embodiment of FIG. 11 differs from the typical or representative embodiment shown in FIG. 2 in that the slow air bleeds 7 in the slow systems communicate at their upstream ends directly with the passages 17, 18 and 19, respectively. The elimination of the auxiliary air bleeds 16 simplifies the structure of the air-fuel ratio control device. The other structure is entirely the same as that in the embodiment shown in FIG. 2 so that any detailed description is unnecessary. The embodiment of FIG. 11 is as effective as the embodiment of FIG. 2, and it is especially advantageous in that the cost of the device is lower than that shown in FIG. 2 due to the simplification of part of the structure.

Figure 12:
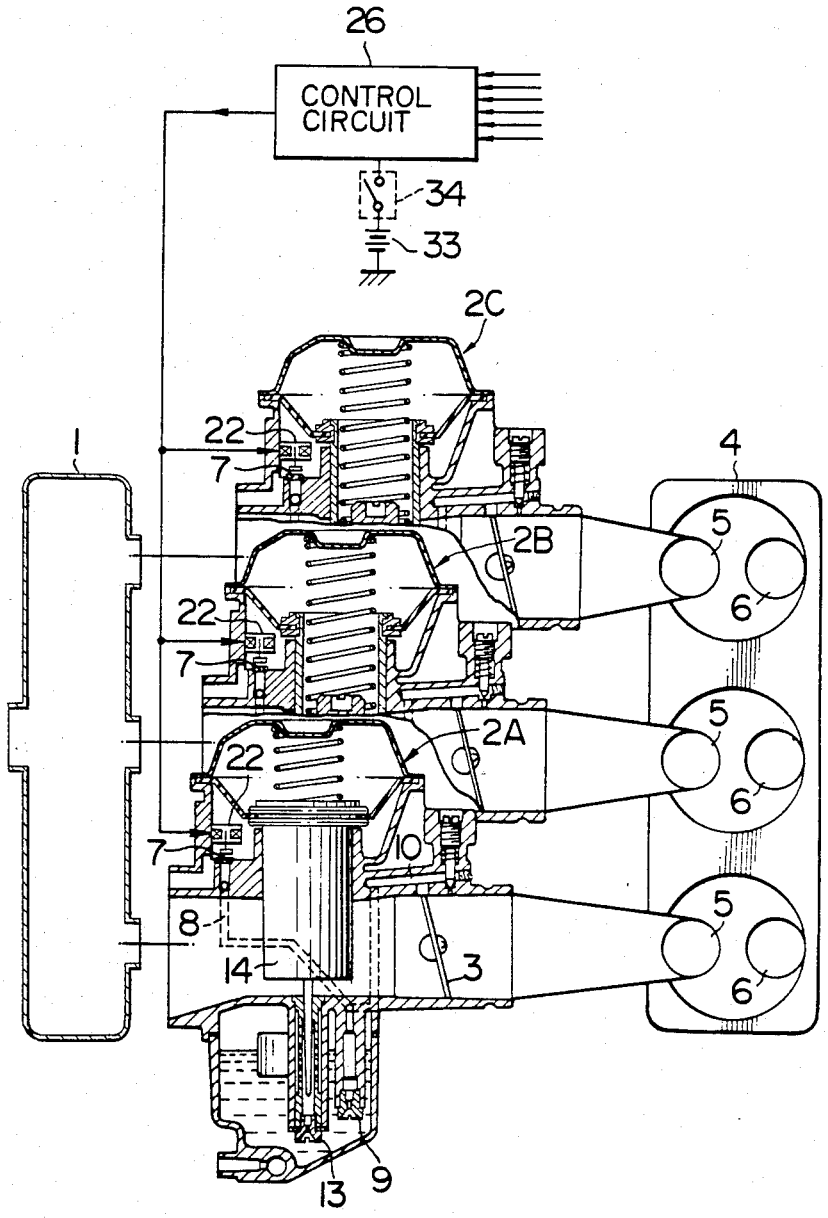

In FIG. 12, the solenoid valve 22 is directly associated with each of the slow air bleeds 7 in the slow systems of the carburetors 2A, 2B and 2C to open and close the upstream end of the slow air bleed 7, so that the flow rate of air supplied through the slow air bleed 7 can be controlled under command of the control circuit 26. The three solenoid valves 22 are simultaneously actuated by the same actuating signal applied from the control circuit 26. The other structure is entirely the same as that of the embodiment shown in FIG. 2 so that any detailed description is unnecessary. Although the number of required solenoid valves 22 is equal to the number of carburetors in the embodiment of FIG. 12, it is especially advantageous over the embodiment shown in FIG. 2 in that elimination of the passages required for communication between the slow systems and the associated solenoid valves improves the response characteristic and ensures better accelerability.

Figure 13:
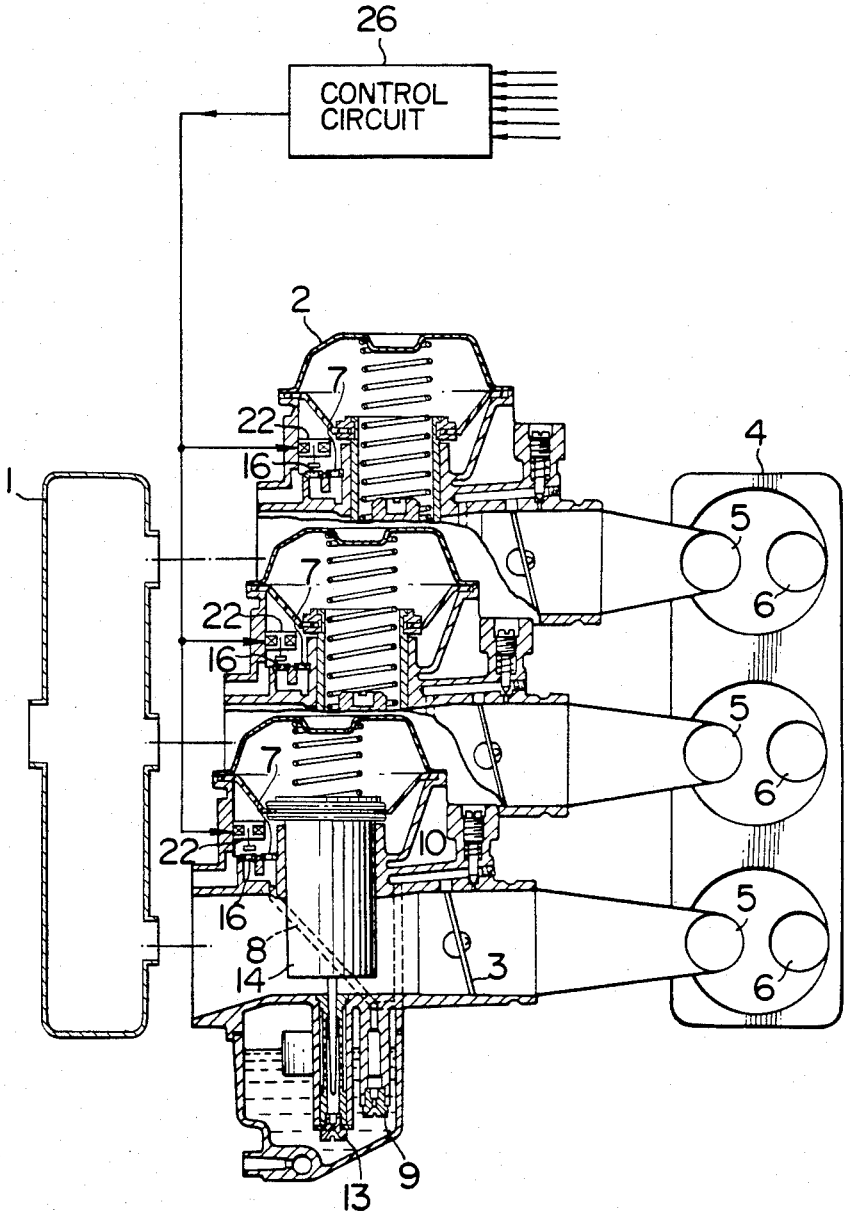

In the embodiment of FIG. 13, the solenoid valve 22 is directly associated with the upstream end of each of the auxiliary air bleeds 16 arranged in parallel with the corresponding slow air bleeds 7. This embodiment of FIG. 13 is as effective as the embodiment shown in FIG. 12.

It will be understood from the foregoing detailed description that the air-fuel ratio control device according to the present invention can improve the rate of atomization of fuel supplied to an internal combustion engine equipped with variable venturi type carburetors each having a slow system, thereby improving the idling performance of the engine and improving the fuel consumption of the engine. In addition, the control device is simple in structure and is therefore inexpensive.

What is claimed is:

1. An air-fuel ratio control device for an internal combustion engine which controls the flow rate of air supplied to a plurality of variable venturi type carburetors with each of the carburetors having a slow system for controlling the air-fuel ratio to set the same at an optimum value in dependence upon operating conditions of the engine, the control device comprising a plurality of sensor means for sensing engine parameters including intake vacuum, engine oil temperature, intake air temperature and atmospheric pressure relating to operating characteristics of the engine, a control circuit means for receiving output signals from said sensor means and a signal indicative of a rotational speed of the engine as its inputs, and at least one solenoid valve means for controlling the flow rate of air flowing through air passages of said slow systems, said solenoid valve means being actuated by a current having an optimum duty ratio computed by said control circuit means in dependence upon the output signals from said sensor means and said rotational speed signal, and wherein the at least one solenoid valve means is associated with an upstream end of an air passage communicating at a downstream end with all upstream ends of slow air bleeds in the individual slow systems of said plurality of carburetors.

2. An air-fuel ratio control device for an internal combustion engine which controls the flow rate of air supplied to a plurality of variable venturi type carburetors with each of the carburetors having a slow system for controlling the air-fuel ratio to set the same at an optimum value in dependence upon operation conditions of the engine, the control device comprising a plurality of sensor means for sensing engine parameters including intake vacuum, engine oil temperature, intake air temperature and atmospheric pressure relating to operating characteristics of the engine, a control circuit means for receiving output signals from said sensor means and a signal indicative of a rotational speed of the engine as its inputs, and at least one solenoid valve means for controlling the flow rate of air flow-through air passages of said slow systems, said solenoid valve means being actuated by a current having an optimum duty ratio computed by said control circuit means in dependence upon the output signals from said sensor means and said rotational speed signal, and wherein auxiliary air bleeds are respectively arranged in parallel with slow air bleeds in the individual slow systems of said plurality of carburetors, and the at least one solenoid valve means is associated with an upstream end of an air passage communicating with a downstream end with all upstream ends of said auxiliary air bleeds.

* * * * *